US009236661B2

(12) United States Patent
Iwanaka et al.

(10) Patent No.: US 9,236,661 B2
(45) Date of Patent: Jan. 12, 2016

(54) RADIOWAVE ABSORBER AND PARABOLIC ANTENNA

(75) Inventors: Daisuke Iwanaka, Tokyo (JP); Akio Kuramoto, Tokyo (JP); Junichi Fukuda, Tokyo (JP)

(73) Assignee: NEC CORPORATION, Tokyo (JP)

( * ) Notice: Subject to any disclaimer, the term of this patent is extended or adjusted under 35 U.S.C. 154(b) by 225 days.

(21) Appl. No.: 13/578,880

(22) PCT Filed: Jul. 29, 2010

(86) PCT No.: PCT/JP2010/062782

§ 371 (c)(1),
(2), (4) Date: Aug. 14, 2012

(87) PCT Pub. No.: WO2011/099183

PCT Pub. Date: Aug. 18, 2011

(65) Prior Publication Data

US 2012/0306712 A1 Dec. 6, 2012

(30) Foreign Application Priority Data

Feb. 15, 2010 (JP) ..... 2010-030712
Mar. 4, 2010 (JP) ..... 2010-048284
Jun. 21, 2010 (JP) ..... 2010-140949

(51) Int. Cl.
*H01Q 13/00* (2006.01)
*H01Q 17/00* (2006.01)
*H01Q 15/14* (2006.01)
(Continued)

(52) U.S. Cl.
CPC ..... *H01Q 17/001* (2013.01); *H01Q 1/42* (2013.01); *H01Q 15/14* (2013.01); *H01Q 17/008* (2013.01); *H01Q 19/10* (2013.01)

(58) Field of Classification Search
CPC ..... H01L 23/552; H01P 1/162; H01Q 15/14; H01Q 17/00; H01Q 19/10; H01Q 19/12; H01Q 19/13; H01Q 19/18; H01Q 19/17; H04B 1/3838; H05K 9/00
USPC ..... 343/781 P, 840, 781, 775, 781 R; 342/1
See application file for complete search history.

(56) References Cited

U.S. PATENT DOCUMENTS 4,263,599 A * 4/1981 Bielli et al. ..... 343/781 R
5,976,666 A * 11/1999 Narang et al. ..... 428/138
(Continued)

FOREIGN PATENT DOCUMENTS

CN 1729735 A 2/2006
CN 101615723 A 12/2009
(Continued)

OTHER PUBLICATIONS

International Search Report, PCT/JP2010/062782, Nov. 2, 2010.
(Continued)

*Primary Examiner* — Dameon E Levi
*Assistant Examiner* — Collin Dawkins
(74) *Attorney, Agent, or Firm* — Young & Thompson

(57) ABSTRACT

A radiowave absorber of the present invention includes: an upper plate that includes a dielectric material containing conductive particles; a lower plate that is arranged parallel to the upper plate, and includes a dielectric material that contains conductive particles; and a plate-shaped support portion that is arranged between the upper plate and the lower plate, and supports the upper plate and the lower plate.

20 Claims, 13 Drawing Sheets

(51) Int. Cl.
*H01Q 19/10* (2006.01)
*H01Q 1/42* (2006.01)

(56) References Cited

U.S. PATENT DOCUMENTS

| | | | | |
|---|---|---|---|---|
| 6,057,796 | A | 5/2000 | Kotsuka | |
| 2005/0001780 | A1* | 1/2005 | Aisenbrey | 343/873 |
| 2006/0246261 | A1* | 11/2006 | Kasabo et al. | 428/182 |
| 2008/0316124 | A1* | 12/2008 | Hook | 343/705 |
| 2009/0184886 | A1* | 7/2009 | Tuau et al. | 343/914 |
| 2012/0306712 | A1 | 12/2012 | Iwanaka | |

FOREIGN PATENT DOCUMENTS

| | | | |
|---|---|---|---|
| CN | 202259699 | U | 5/2012 |
| EP | 0875957 | A2 | 11/1998 |
| JP | 54-122067 | | 9/1979 |
| JP | 56-086507 | | 7/1981 |
| JP | 61-097207 | | 6/1986 |
| JP | 02-142200 | | 5/1990 |
| JP | 06-120689 | | 4/1994 |
| JP | 2000-261241 | | 9/2000 |

OTHER PUBLICATIONS

Chinese First Official Action dated Dec. 9, 2013; Application No. 201080063318.4.

Chinese Office Action dated May 26, 2014; Application No. 201080063318.4.

* cited by examiner

RADIOWAVE ABSORBER AND PARABOLIC ANTENNA

TECHNICAL FIELD

The present invention relates to a radiowave absorber and a parabolic antenna. In particular, the present invention relates to a radiowave absorber that is easy to handle, inexpensive, lightweight, and has a good oblique incidence characteristic, and a parabolic antenna.

BACKGROUND ART

A radiowave absorber may be used as a means for avoiding radiowave interference. Generally, a radiowave absorber is sponge made of resin such as polyurethane including carbon particles, such as carbon, and has conductivity. An installation example of a radiowave absorber includes a parabolic antenna that is used for point-to-point communication. In order not to radiate radiowaves as much as possible in the direction outside the opposing counter station, it is necessary to keep the sides lobes of the antenna low. As a measure, a constitution is often used that provides a shroud around the parabolic reflector, and affixes a radiowave absorber on the inner side of this shroud.

FIG. 13 shows the constitution of a conventional parabolic antenna 900. This parabolic antenna 900 is constituted from a reflector (parabolic reflector) 910, a shroud 920, a primary radiator 930, and a radiowave absorber 800. As a radiowave absorber, Patent Document 1 discloses a radiowave absorber constituted from a radiowave reflecting film, a resistance film, and a spacer.

PRIOR ART DOCUMENT

Patent Document

[Patent Document 1] Japanese Unexamined Patent Application, First Publication No. 2000-261241

SUMMARY OF THE INVENTION

Problem to be Solved by the Invention

Since the conventional radiowave absorber shown in FIG. 13 has a sponge shape or a capillary shape, the method of attaching and fixing it is difficult. Also, this radiowave absorber deteriorates with the passage of time, becoming a powder and dispersing or breaking into pieces. When the radiowave absorber in a powdered state adheres to the reflector, the radiowave reflecting performance deteriorates. Also, due to the reduction of the radiowave absorber, the radiowave absorption characteristic deteriorates, and the side-probe characteristic deteriorates.

According to the radiowave absorber disclosed in Patent Document 1, a dielectric material is filled in the spacer that supports the radiowave reflecting film and the resistance film. However, adopting this kind of configuration makes the radiowave absorber expensive.

Means for Solving the Problem

In order to solve the aforementioned problems, a radiowave absorber according to a first exemplary aspect of the present invention includes: an upper plate that includes a dielectric material containing conductive particles; a lower plate that is arranged parallel to the upper plate, and includes a dielectric material that contains conductive particles; and a plate-shaped support portion that is arranged between the upper plate and the lower plate, and supports the upper plate and the lower plate.

A parabolic antenna according to a second exemplary aspect of the present invention includes: a parabolic reflector that reflects radiowaves; a cylindrical shroud that is attached to an aperture edge of the parabolic reflector so as to maintain an aperture of the parabolic reflector; a primary radiator that radiates radiowaves; and a radiowave absorber according to the first exemplary aspect of the present invention, that is arranged on an inside perimeter of the shroud.

The above description does not list all of the characteristics necessary for the exemplary aspects of the present invention, and sub-combinations of these characteristics can also serve as an exemplary aspect of the invention.

Effect of the Invention

According to the present invention, a radiowave absorber that is lightweight and inexpensive can be provided.

EMBODIMENTS FOR CARRYING OUT THE INVENTION

Hereinbelow, exemplary embodiments of the present invention shall be described, but the following exemplary embodiments do not limit the present invention. Also, all of the combinations of the characteristics of the exemplary embodiment described hereinbelow are not necessarily indispensable to the solution means of the present invention.

Figure 1:
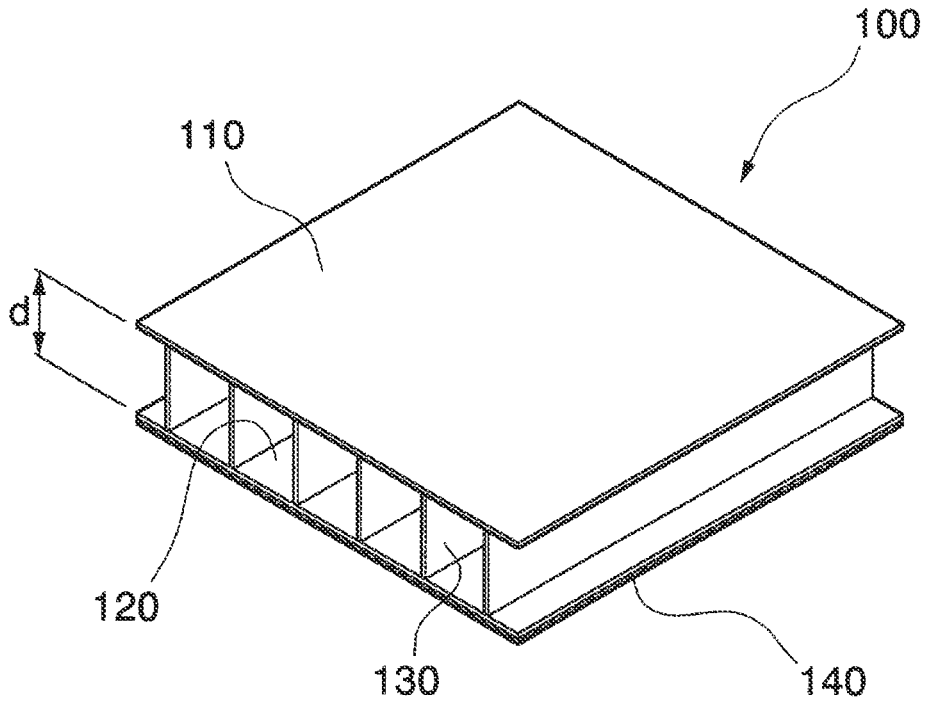
FIG. 1 is a perspective view that shows one example of the constitution of a radiowave absorber according to one exemplary embodiment of the present invention.
Figure 2:
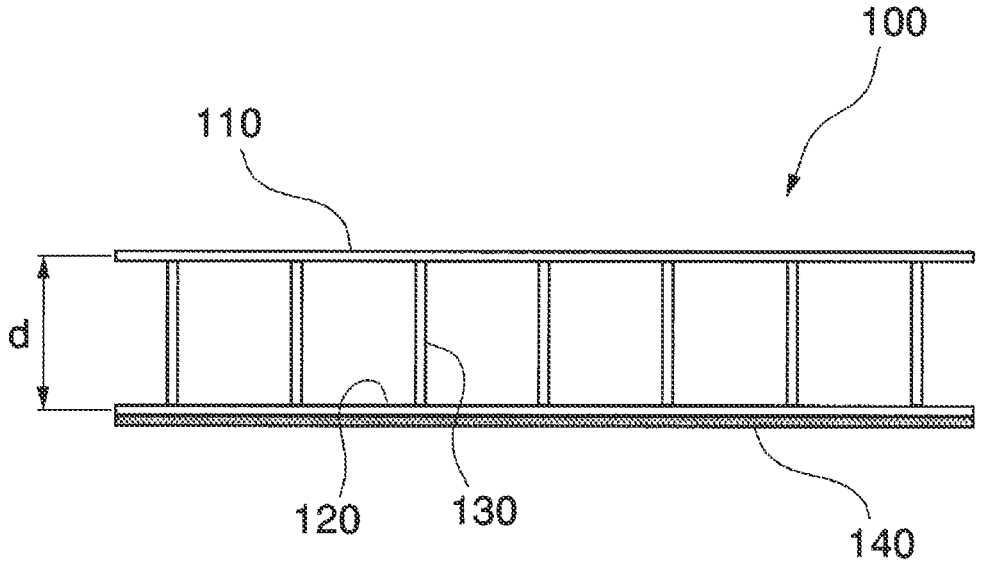
FIG. 2 is a side view that shows the one example of the constitution of the radiowave absorber according to the one exemplary embodiment of the present invention.

FIG. 1 and FIG. 2 show one example of the constitution of a radiowave absorber 100 according to one exemplary embodiment. The radiowave absorber 100 has an upper plate 110 and a lower plate 120, a support portion 130, and a metal plate 140. The upper plate 110 and the lower plate 120 are arranged to be mutually parallel. The support portion 130 is plate shaped, is provided between the upper plate 110 and the lower plate 120, and supports the upper plate 110 and the lower plate 120. The metal plate 140 is arranged below the lower plate 120.

By constituting the support portion 130 with a plate-shaped dielectric material and not filling the inside, it is possible to reduce the amount used of the dielectric material, and it is possible to constitute the radiowave absorber 100 that is lightweight and inexpensive. The upper plate 110, the lower plate 120 and the support portion 130 have a conduction loss by including conductive particles such as carbon, resistive elements, and metal powder in the dielectric material, and thereby have a limited value of resistance. By imparting a conduction loss to all of the upper plate 110, the lower plate 120 and the support portion 130, the characteristic is improved. However, generally it is more inexpensive to impart a conduction loss to only the upper plate 110 and the lower plate 120. Examples of a method of including conductive particles in the dielectric material include coextrusion, printing and coating. As the dielectric material that is used for the radiowave absorber 100, a plastic material such as polypropylene is used. For this reason, handling of the radiowave absorber 100 is easy, and since it does not become a powder and disperse, it hardly degrades over time. More specifically, as one example, the radiowave absorber 100 can be formed by forming the upper plate 110, the lower plate 120 and the support portion 130 with a plastic thin plate, and applying to the surface a coating that includes conductive particles such as carbon. In the case of using polypropylene for the plastic thin plate, the effects are obtained of being lightweight, having excellent resistance and flexibility, and being easy to handle.

Figure 3A:
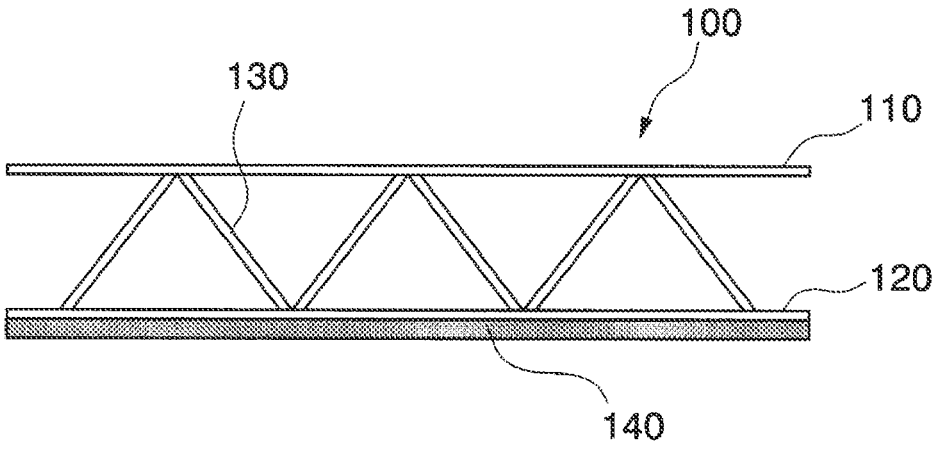
FIG. 3A is a diagram that shows another example of the constitution of the radiowave absorber according to the one exemplary embodiment of the present invention.
Figure 3B:
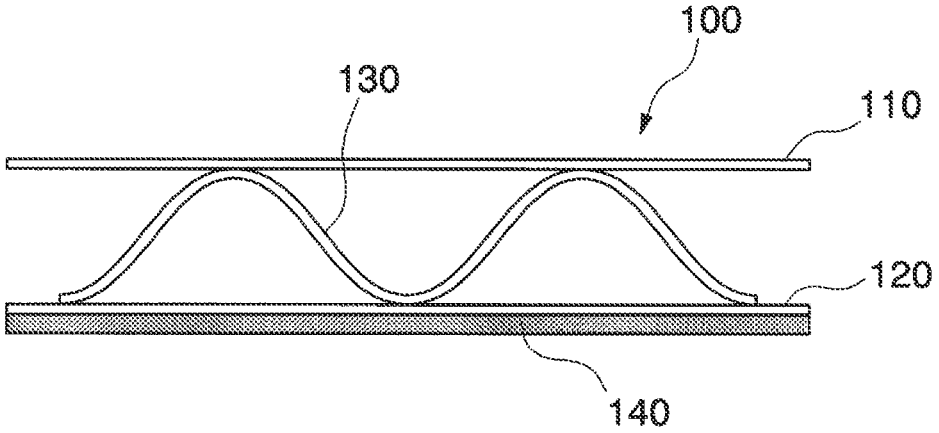
FIG. 3B is a diagram that shows another example of the constitution of the radiowave absorber according to the one exemplary embodiment of the present invention.
Figure 3C:
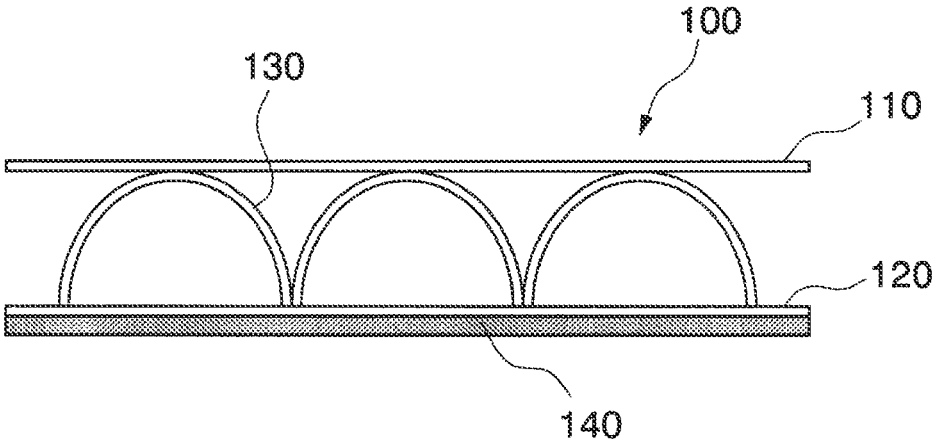
FIG. 3C is a diagram that shows another example of the constitution of the radiowave absorber according to the one exemplary embodiment of the present invention.

FIG. 3A to FIG. 3C show other examples of the constitution of the radiowave absorber 100 according to the one exemplary embodiment. In the radiowave absorber 100 of this exemplary embodiment, the structure of the support portion 130 differs. FIG. 3A shows the radiowave absorber 100 that has a sloping plate-shaped support portion 130. FIG. 3B shows the radiowave absorber 100 that has a corrugated support portion 130. FIG. 3C shows the radiowave absorber 100 that has a semicircle-shaped support portion 130. Provided the support portion 130 has a shape that is capable of supporting the upper plate 110 and the lower plate 120, it is acceptable for it to be a structure other than the structures shown in FIG. 3A to FIG. 3C. In the case of the support portion 130 having a conduction loss, the oblique incidence characteristic differs depending on the structure of the support portion 130.

Figure 4:
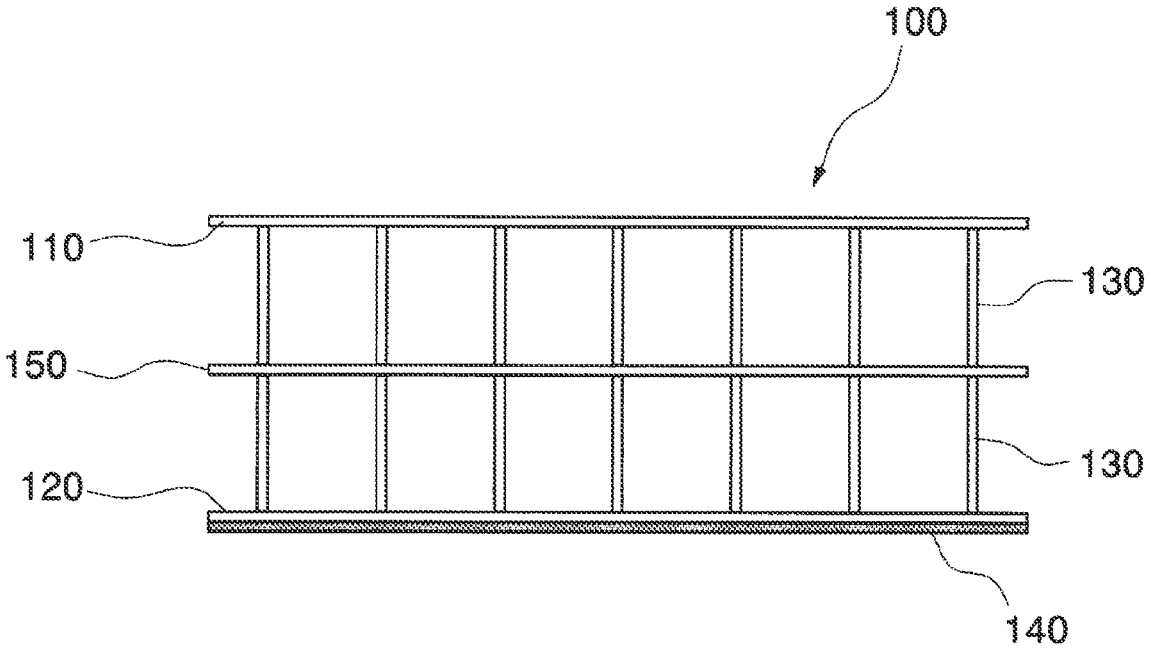
FIG. 4 is a diagram that shows still another example of the constitution of the radiowave absorber according to the one exemplary embodiment of the present invention.

FIG. 4 shows still another example of the constitution of the radiowave absorber 100 according to the one exemplary embodiment. This radiowave absorber 100 has a multi-layer structure in which an intermediate plate 150 is sandwiched between the upper plate 110 and the lower plate 120. In the example shown in FIG. 4, the number of plates (that is to say, the total of the upper plate 110, the lower plate 120, and the intermediate plate 150) is three, but it may also be four or more.

Figure 5:
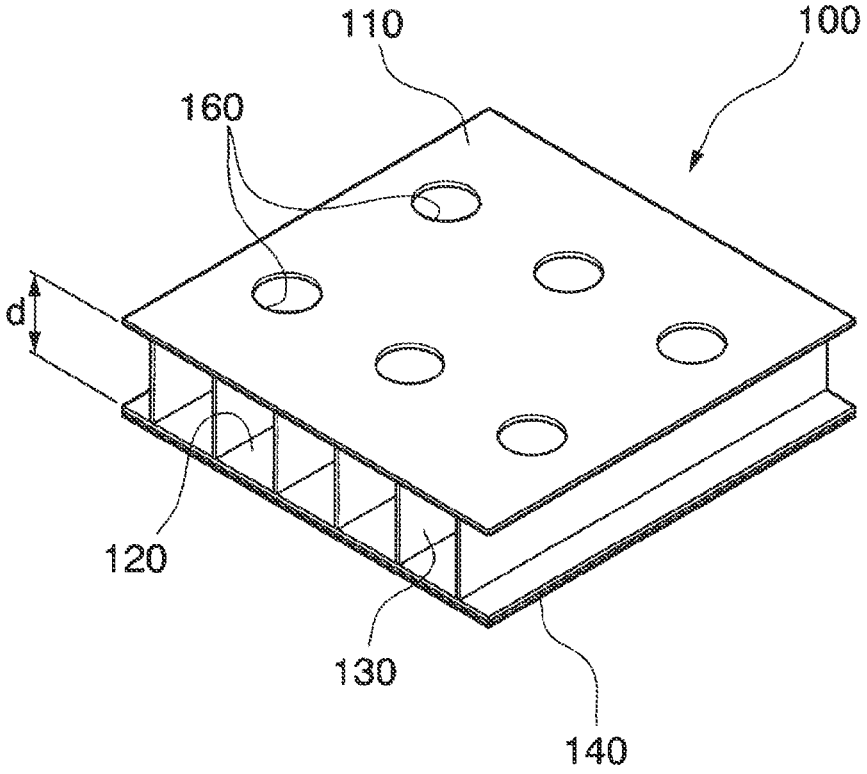
FIG. 5 is a diagram that shows still another example of the constitution of the radiowave absorber according to the one exemplary embodiment of the present invention.

FIG. 5 shows still another example of the constitution of the radiowave absorber 100 according to the one exemplary embodiment. In this radiowave absorber 100, a plurality of holes 160 are provided in the surface thereof. With this constitution, the space impedance matching and the radiowave oblique incidence characteristic of the radiowave absorber 100 are improved. The shape of the hole 160 may be any shape such as square, rectangular, triangular, polygonal, and the like.

Figure 6:
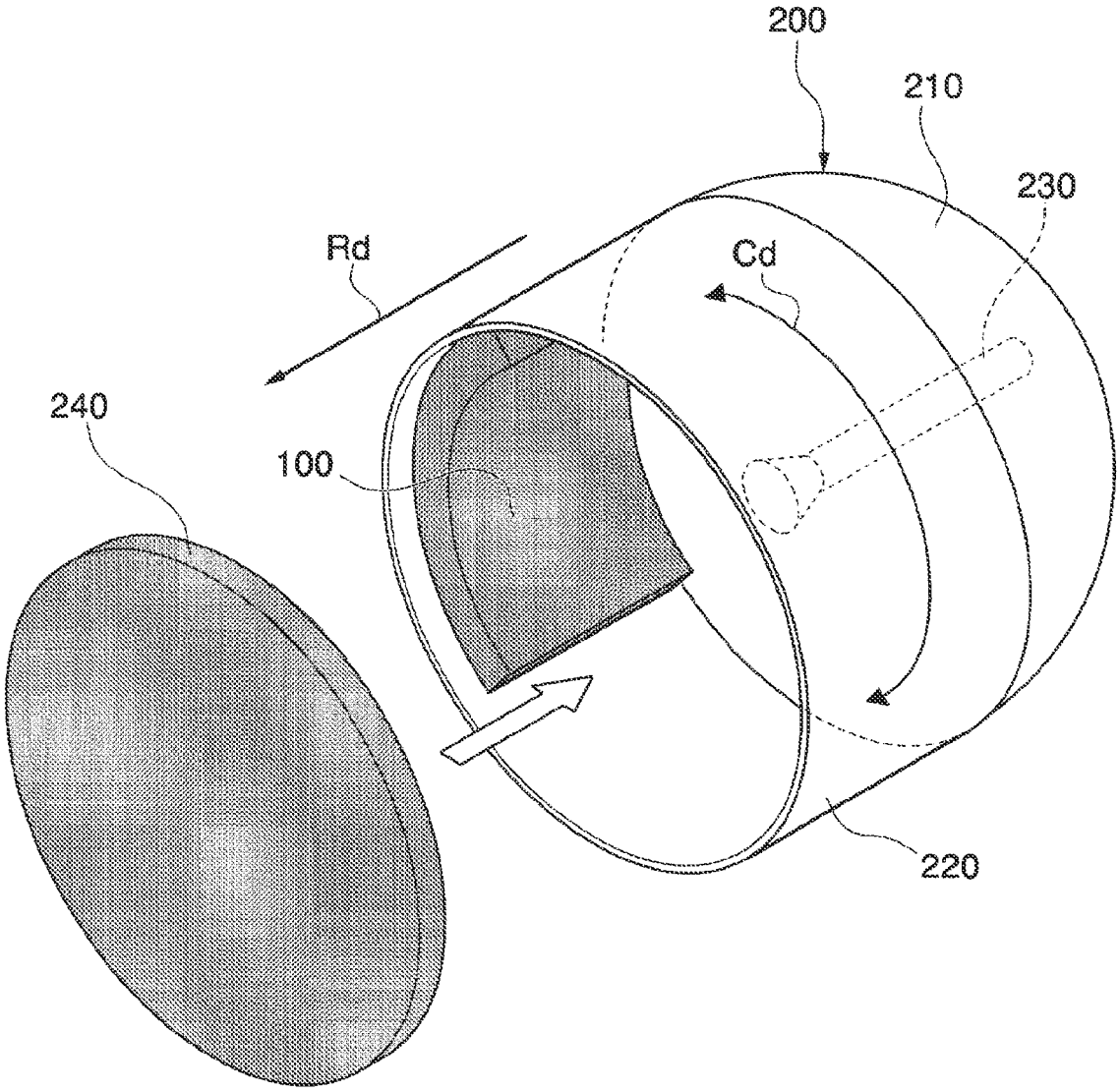
FIG. 6 is a diagram that shows an example of the radiowave absorber according to the one exemplary embodiment of the present invention installed in a parabolic antenna.

FIG. 6 shows an example of the radiowave absorber 100 installed in a parabolic antenna 200. The parabolic antenna 200 has a reflector (parabolic reflector) 210, a shroud (covering portion) 220, a primary radiator 230, a radome 240, and the radiowave absorber 100. The radome 240 is added to the radiowave absorber 100 shown in FIG. 6. However, the radome 240 may not be added to the radiowave absorber 100. FIG. 6 and subsequent figures show the case of the radiowave absorber 100 being arranged at a portion on the inside periphery of the shroud 220 (the inside periphery along the circumferential direction Cd of the shroud 220). However, there are cases of the radiowave absorber 100 being arranged on a portion of the circumference of the shroud 220 or along the entire circumference of the shroud 220. Although the length in the radiation direction of the radiowave absorber 100 is arbitrary, normally it is generally set to the same length as the width of the shroud 220 (length in the radiation direction Rd).

Figure 7:
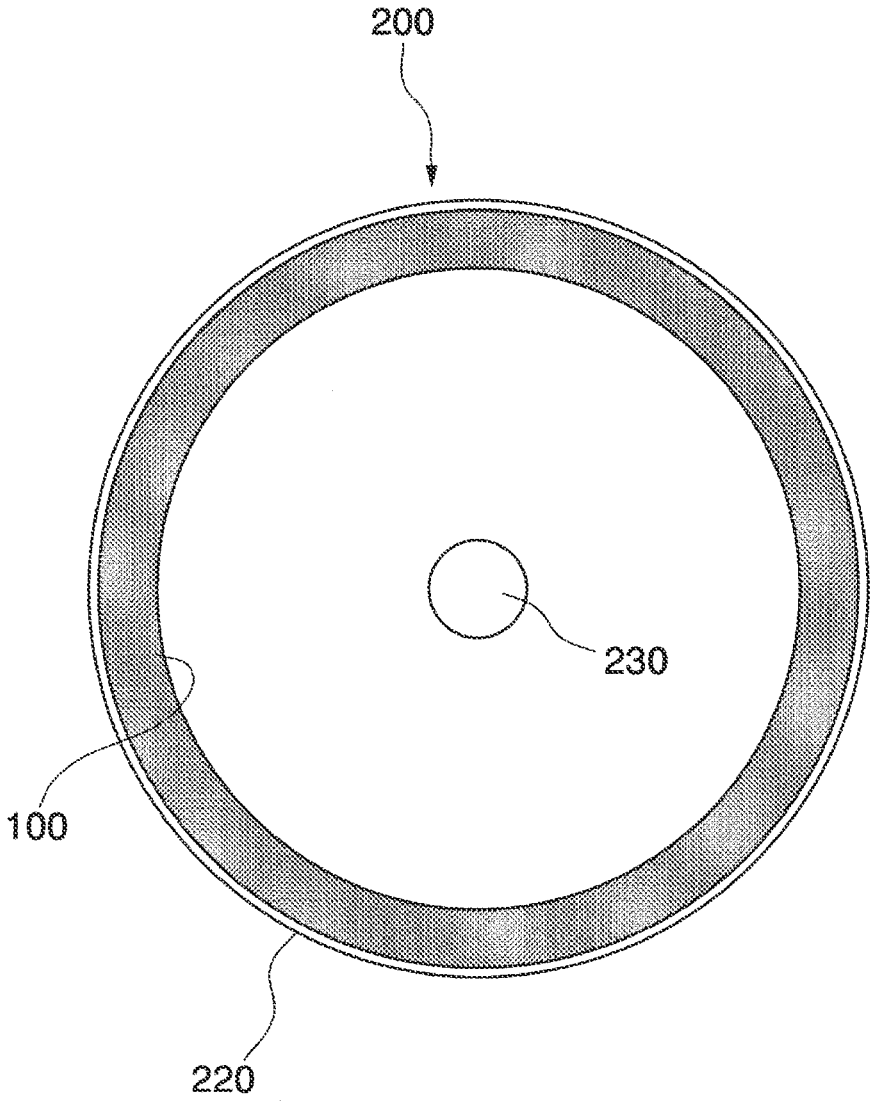
FIG. 7 is a diagram that shows the constitution of the parabolic antenna shown in FIG. 6 seen from the left side in the state of a radome removed.

FIG. 7 shows the constitution of the parabolic antenna 200 seen from the left side in FIG. 6, in the state of the radome 240 of the parabolic antenna 200 shown in FIG. 6 being removed. The radiowave absorber 100 is arranged in close contact along the circumferential direction (perimeter direction) on the inside circumference (inside perimeter) of the shroud 220.

Figure 8:
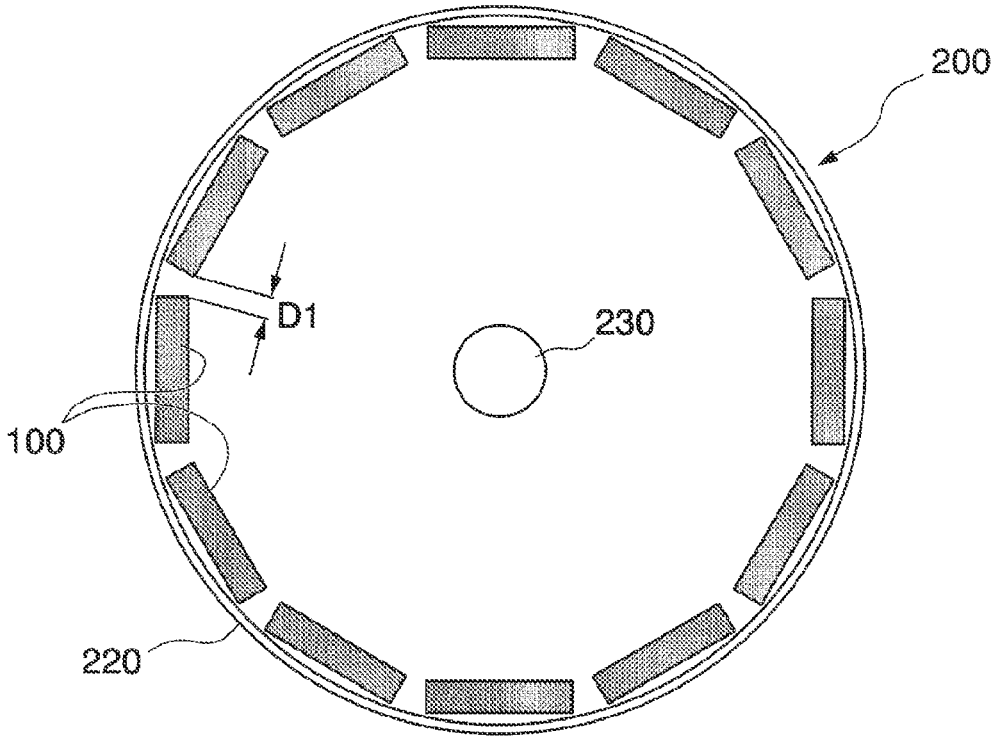
FIG. 8 is a diagram that shows another example of the radiowave absorber according to the one exemplary embodiment of the present invention installed in the parabolic antenna.

FIG. 8 shows another example of the radiowave absorber 100 installed in the parabolic antenna 200. The radiowave absorber 100 is arranged on the inside circumference of the shroud 220 separated by an interval Dl.

Figure 9:
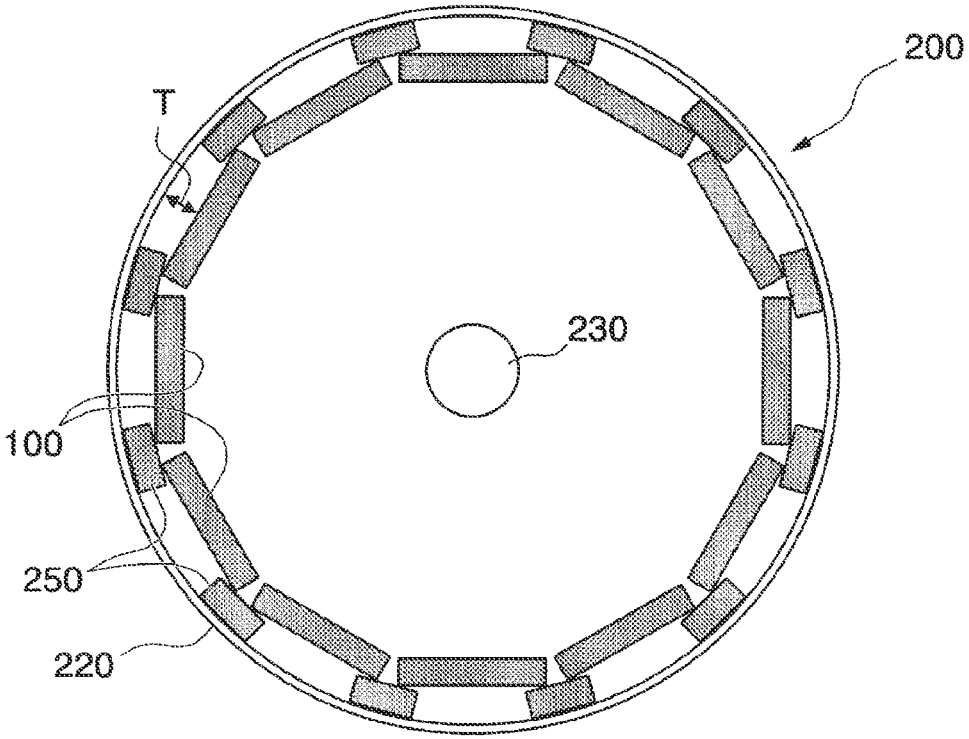
FIG. 9 is a diagram that shows still another example of the radiowave absorber according to the one exemplary embodiment of the present invention installed in the parabolic antenna.

FIG. 9 shows still another example of the radiowave absorber 100 installed in the parabolic antenna 200. The radiowave absorber 100 is constituted by a dielectric material that has a conduction loss. With a spacer 250 serving as a base, the radiowave absorber 100 is arranged along the inside circumference of the shroud 220 raised by the height T of the spacer 250. In this case, there is a case where the spacer 250 is arranged partially or discretely, and there is a case where the spacer 250 is arranged uniformly without a gap on the inner circumference. As for the material of the spacer 250, the same material as the radiowave absorber 100 may be used, and a lightweight plastic material may also be used.

Figure 10A:
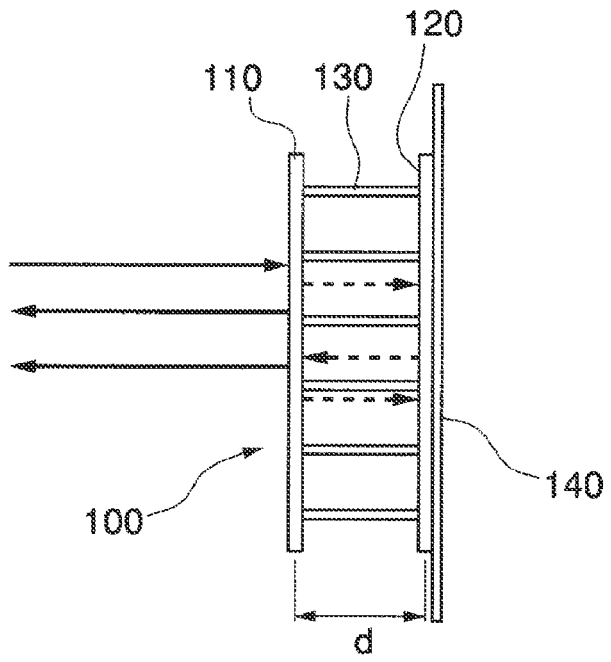
FIG. 10A is an illustrative diagram of the resistance value of the radiowave absorber according to the one exemplary embodiment of the present invention and the height of a support portion.
Figure 10B:
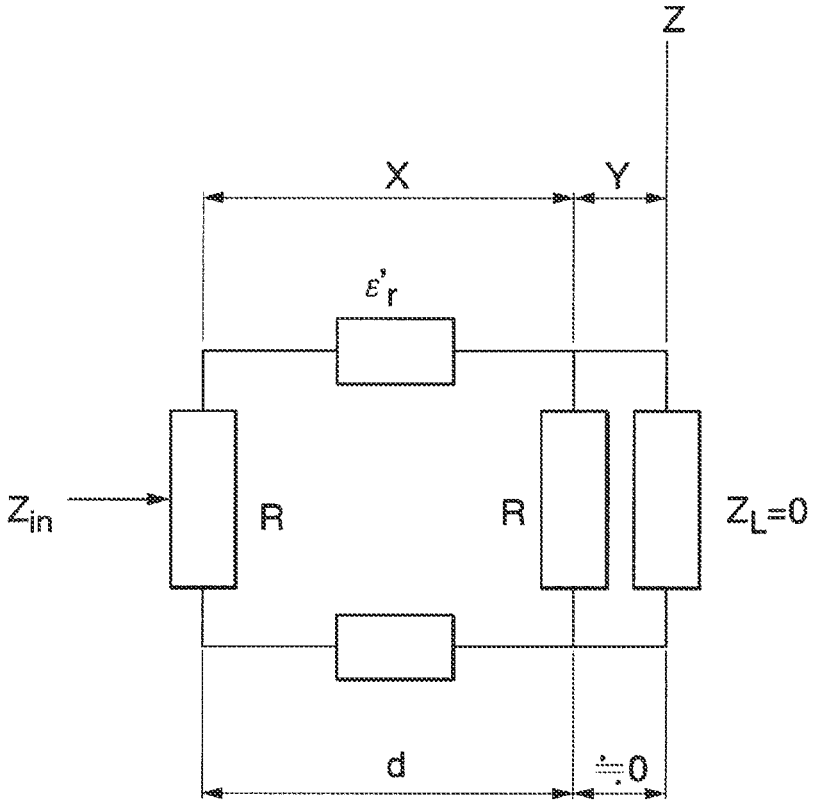
FIG. 10B is an illustrative diagram of the resistance value of the radiowave absorber according to the one exemplary embodiment of the present invention and the height of the support portion.

Referring to FIG. 10A and FIG. 10B, the method of designing the resistance value R of the radiowave absorber 100 and the height d of the support portion 130 shall be described. FIG. 10A shows the appearance of reflection when a radiowave is incident on the radiowave absorber 100. FIG. 10B shows an equivalent circuit when the radiowave absorber 100 is replaced with a distributed constant line. The radiowave absorber 100 that is described here corresponds to all of the radiowave absorbers 100 shown in FIGS. 1 to 19. FIG. 10A shows the appearance of reflection in the case of a radiowave being perpendicularly incident on the radiowave absorber 100. The radiowave that is incident on the radiowave absorber 100 is divided into a radiowave that is reflected by the surface of the radiowave absorber 100 and a radiowave that enters the interior of the radiowave absorber 100. Moreover, regarding radiowaves that have entered the interior, there are radiowaves that are reflected by the metal plate 140 and leave the radiowave absorber 100, and there are radiowaves that are reflected by the interface between the radiowave absorber 100 and free space and return to the interior of the radiowave absorber 100. In this way, multipath reflections occur in the interior of the radiowave absorber 100. For that reason, it is more comprehensible to replace it with an equivalent circuit using the distributed constant line as shown in FIG. 10B. Here, the case of only the upper place 110 and the lower plate 120 of the radiowave absorber 100 of the exemplary embodiment of the present invention having a conduction loss shall be described. First, the equivalent circuit shall be described. In FIG. 10B, X denotes the radiowave absorber, Y the interval between the radiowave absorber and the shroud, and Z the shroud. R is the resistance value of the upper plate 110 and the lower plate 120, $Z_L$ is the impedance of the metal plate 140, and $Z_L$=0. Since the radiowave absorber 100 is formed using a dielectric material, the relative permittivity $\in_r$ of the dielectric material also must be taken into consideration. In the present exemplary embodiment, since the density of the dielectric material is extremely low due to the structure of the support portion 130, it is more accurate to use an equivalent relative permittivity $\in'_r$ that takes into account the density of the dielectric material. In the case of the lower plate 120 and the metal plate 140 being bonded together, due to the parallel connection of the impedance value $Z_L$ and R, the impedance is 0Ω. Using the equivalent circuit of FIG. 10B, the impedance $Z_{in}$ of the radiowave absorber 100 seen from free space is found by Equation (1). Here, the relative permeability $\mu_r$ of a medium is calculated as 1.

[Equation 1]

$$Z_{in} = \frac{R \cdot Z_c \tanh\gamma d}{R + Z_c \tanh\gamma d} \tag{1}$$

At this time, the characteristic impedance $Z_c$ and the propagation coefficient γ of the support portion are as follows.

[Equation 2]

$$Z_c = \frac{Z_0}{\sqrt{\varepsilon'_r}} \tag{2}$$

[Equation 3]

$$\gamma = j\frac{2\pi}{\lambda}\sqrt{\varepsilon'_r} \tag{3}$$

Using this equation, the resistance value R and height d of the support portion 130 are designed so that the impedance $Z_{in}$ of the radiowave absorber 100 becomes equivalent to the impedance $Z_0$ of the free space, which is 377Ω. If impedance matching of the free space and the radiowave absorber 100 is performed, reflection does not occur, and all of the radiowaves enter the radiowave absorber 100, and attenuate due to conductor loss. By adjusting the resistance value and the height of the support portion 130, it is possible to improve the absorption characteristic in accordance with the frequency.

In this explanation, in the case of the lower plate 120 and the metal plate 140 being in close contact, the total impedance of the lower plate 120 and the metal plate 140 becomes 0Ω. For this reason, while the lower plate 120 having a resistance value may be considered not significant, it has the important role of inhibiting the radiation of surface waves transmitted through the metal plate 140.

Next, the reason for imparting a conductor loss to the support portion 130 shall be explained. In perpendicular incidence, the absorption loss is sufficiently good if only the upper plate 110 and the lower plate 120 have a conductor loss. However, in the oblique incidence characteristic, the case of the support portion 130 also having a conductor loss has a good absorption characteristic. Since the oblique incidence characteristic differs depending on the structure of the support portion 130, it is good to select the structure of the support portion 130 in accordance with the necessary angle. The corrugated support portion 130 has a good absorption characteristic over a wide angle.

Next, the case of using the spacer 250 shall be described. The reason for using the spacer 250 is to perform impedance matching of the free space and the radiowave absorber 100. That is to say, by changing the distance from the surface of the radiowave absorber 100 in contact with the free space to the metal plate 140, space impedance matching is taken, and the absorption performance is improved. At this time, it is necessary to carry out design considering the relative permittivity of the medium used for the spacer 250. In the case of simply making the absorber thick using the same material as the radiowave absorber 100 in the spacer 250, the design is easier. However, in the case of using a lower cost dielectric material as the spacer 250, it is possible to carry out the manufacturing at a lower cost.

Next, the case of arranging the radiowave absorber 100 so as to be divided and spaced apart shall be described. This has two meanings of improvement of the oblique incidence characteristic and space impedance matching. Also, it is possible to consider the case of providing the holes 160 in the radiowave absorber 100 in the same manner.

First, improvement of the oblique incidence characteristic shall be described. Generally, when the incidence angle is increased, the more the medium differs, the greater the reflection becomes. For that reason, there is a method of inserting and absorbing oblique incident waves by arranging the radiowave absorber 100 spaced apart, or providing the holes 160. This is a method that causes multipath reflection at the side surface of the absorber, and attenuates the radiowaves. It is necessary to adjust the interval and thickness of the gap or hole 160 depending on the incidence angle.

Next, the impedance matching characteristic improvement shall be explained. In the case of arranging the radiowave absorber 100 spaced apart, or in the case of providing the holes 160 in the radiowave absorber 100, it is possible to equivalently lower the relative permittivity of a medium. When the relative permittivity of a medium is high, the frequency band in which matching with free space cannot be taken widens. Also, in the exemplary embodiment of the present invention, since the radiowave absorber 100 has resistance on the surface, it is possible to also lower that resistance equivalently. By providing the gap or hole 160, it is possible to lower the relative permittivity of the medium, and it is possible to put it in a state closer to the free space. For that reason, there is a case where the absorption performance can be improved. However, excessively providing the gap or hole 160 yields adverse results as it increases the reflected waves and radiowave attenuation is not performed by the absorber.

As mentioned above, it is necessary to adjust the extent of providing the gap and hole 160 while confirming the absorption performance of the radiowave absorber 100.

Figure 11A:
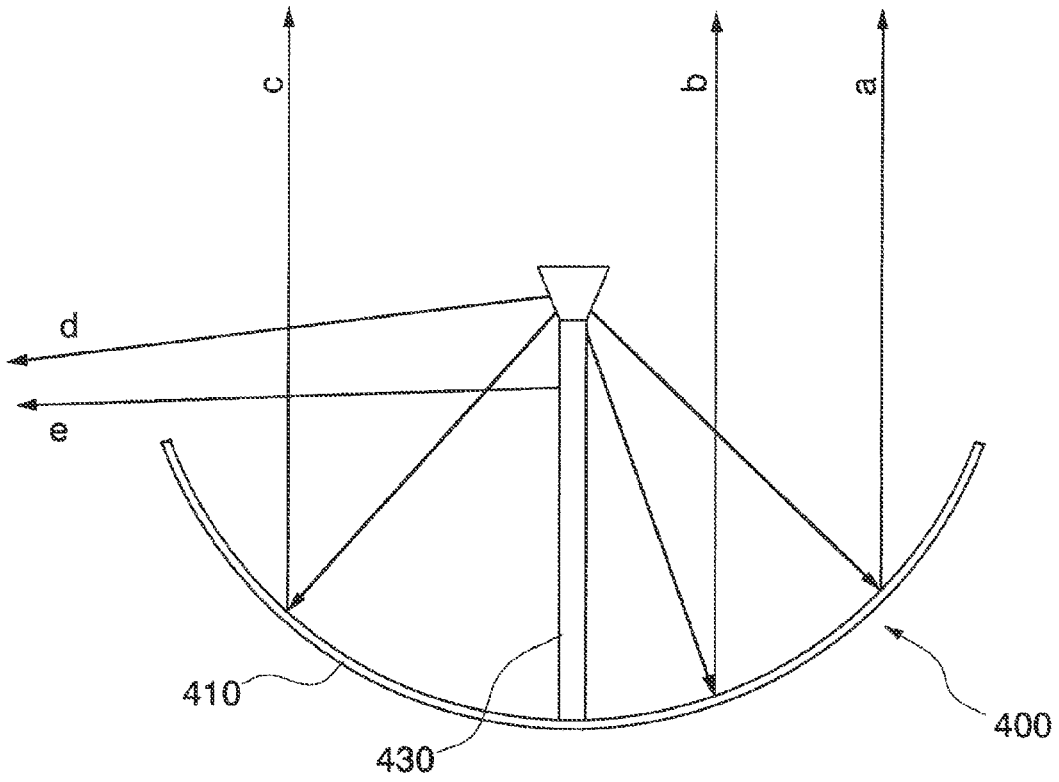
FIG. 11A shows a cross-sectional view of a parabolic antenna with no radiowave absorber according to the one exemplary embodiment of the present invention.
Figure 11B:
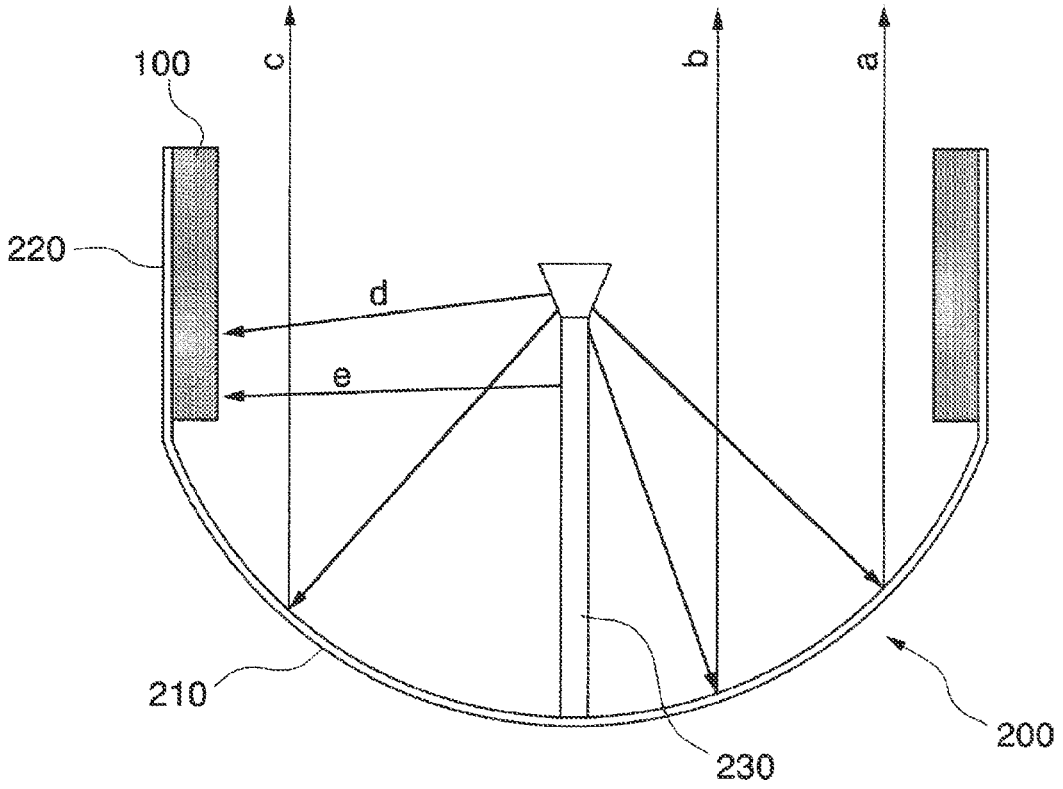
FIG. 11B shows a cross-sectional view of the parabolic antenna that has the radiowave absorber according to the one exemplary embodiment of the present invention.

Next, the role of the radiowave absorber 100 in the parabolic antenna 200 shall be described. FIG. 11A shows a cross-sectional view of a parabolic antenna 400 with no radiowave absorber 100. FIG. 11B shows a cross-sectional view of the parabolic antenna 200 that has the radiowave absorber 100 and a shroud 220 to which the radiowave absorber 100 is affixed. Generally, in the parabolic antenna 200 (400), radiowaves are radiated from the distal end portion of the primary radiator 230 (430) toward the reflector (parabolic reflector) 210 (410). By designing the curved surface of the reflector 210 (410) to be a paraboloid of revolution (parabolic curved surface), radiowaves a, b, and c are radiated in the same direction at the same phase, and by being combined it is possible to obtain a high gain. It is designed so that the radiowaves that are radiated from the primary radiator 230 (430) are to the extent possible emitted toward to the reflector 210 (410), but as shown in FIG. 11A, there are some radiowaves such as radiowaves d and e that leak to the outside. This becomes a side lobe, and is a cause of degrading antenna performance. In order to prevent this, ordinarily, as shown in FIG. 11B, a cylindrical shroud 220 is provided, the radiowave absorber 100 is affixed on the inside thereof, and the radiowaves d and e are absorbed by this radiowave absorber 100. This cylindrical shroud 220 is attached at the aperture edge of the reflector 210 so as to maintain the aperture of the reflector 210. In the present exemplary embodiment, the constitution, shape, and manner of arrangement of this radiowave absorber 100 are devised.

Figure 12:
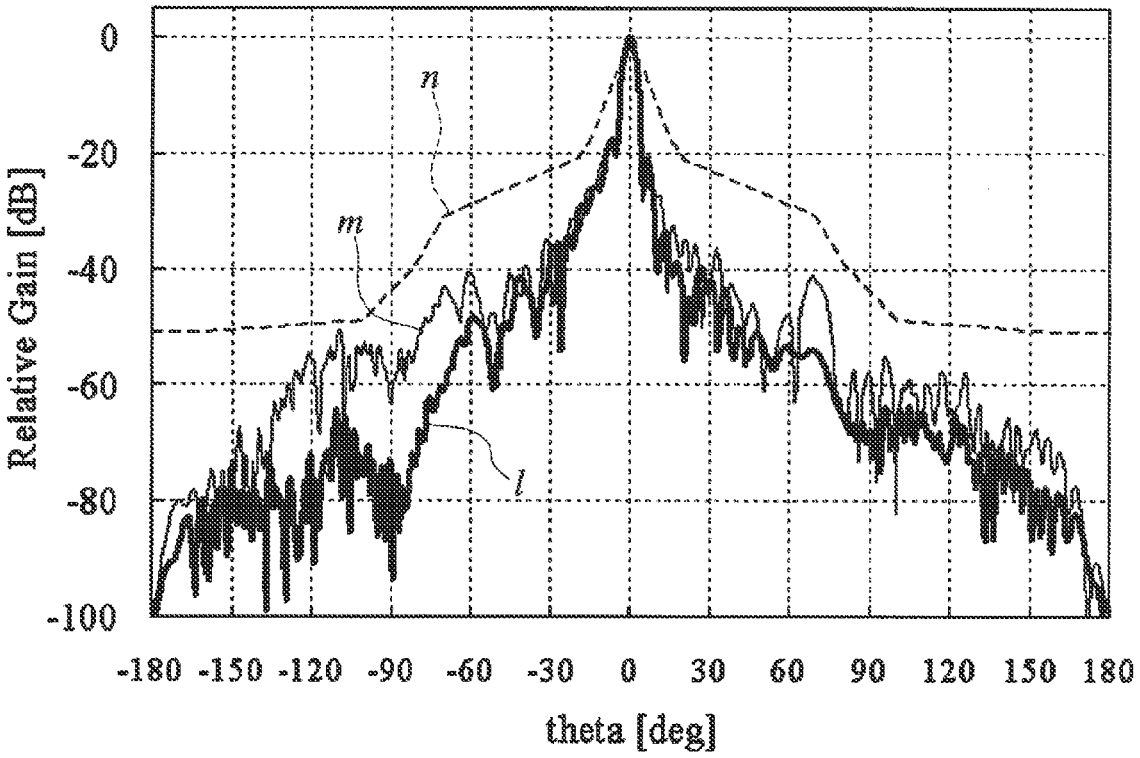
FIG. 12 is a diagram that shows the radiation pattern characteristic of the parabolic antenna according to the one exemplary embodiment of the present invention.
Figure 13:
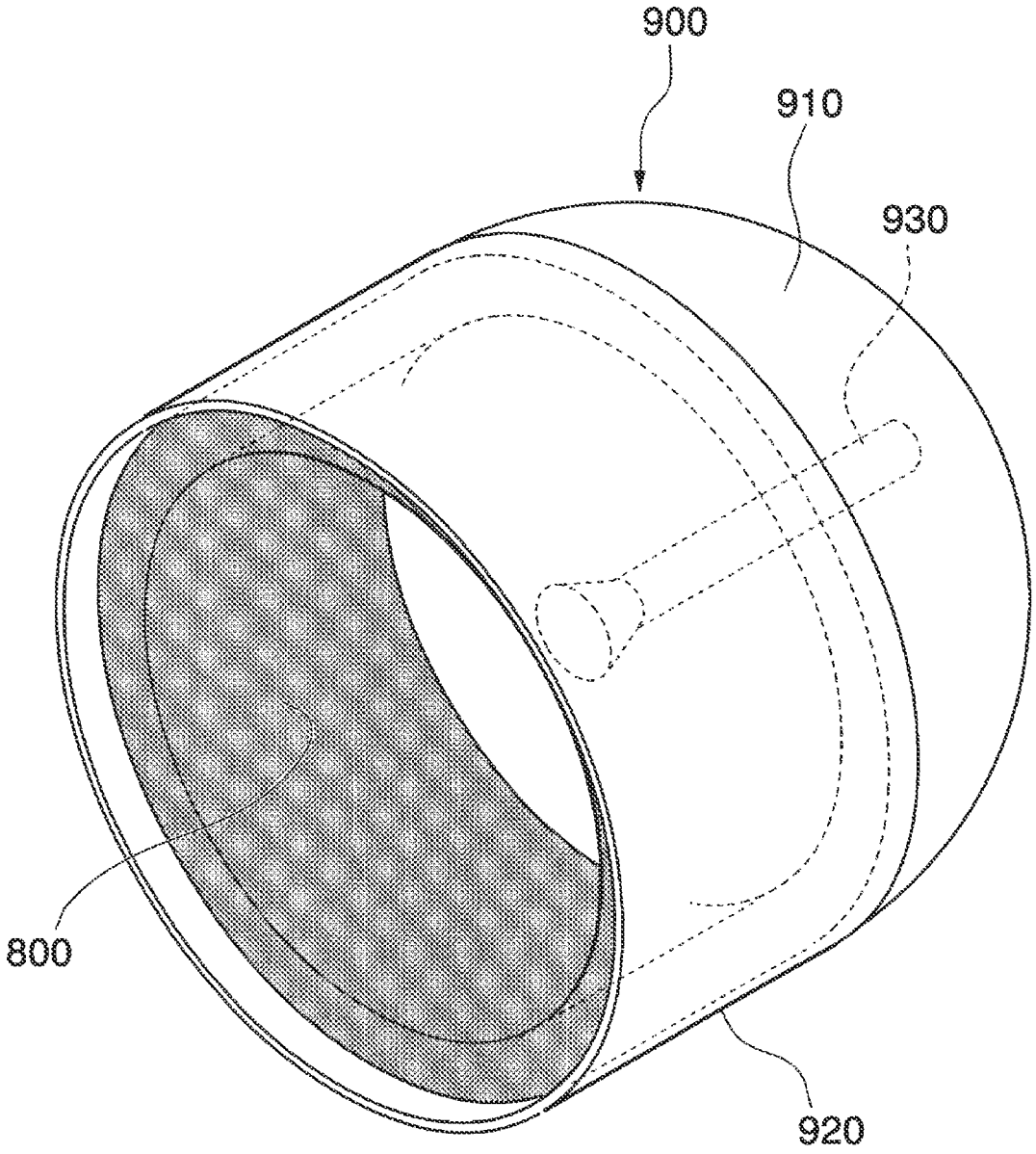
FIG. 13 is a diagram that shows the constitution of a conventional parabolic antenna.

FIG. 12 shows an example of the radiation pattern characteristic of the parabolic antenna 200 that uses the radiowave absorber 100. These radiation patterns are the measurement values of the radiation pattern of a 15 GHz band parabolic antenna with an effective aperture diameter of approximately 30 cm. A vertical polarization was measured in the azimuth plane. The horizontal axis denotes the angle, while the vertical axis denotes the relative level normalized at 0 degrees. The thick solid line 1 is the measurement value in the case of arranging the radiowave absorber that has the structure of FIG. 1 in the constitution of FIG. 6. The thin line m is the measurement value in the case of not arranging the radiowave absorber. Also, the dashed line n is the standard of the radiation pattern that is applied to this type of antenna, and is based on the European standard ETSI EN 302 217. In the case of not providing the radiowave absorber 100, the margin with respect to the ETSI standard is approximately 1 dB. On the other hand, in the case of providing the radiowave absorber 100 of the present exemplary embodiment, the margin with the standard is approximately 15 dB, and so a large side lobe reduction effect is obtained.

Figure 14:
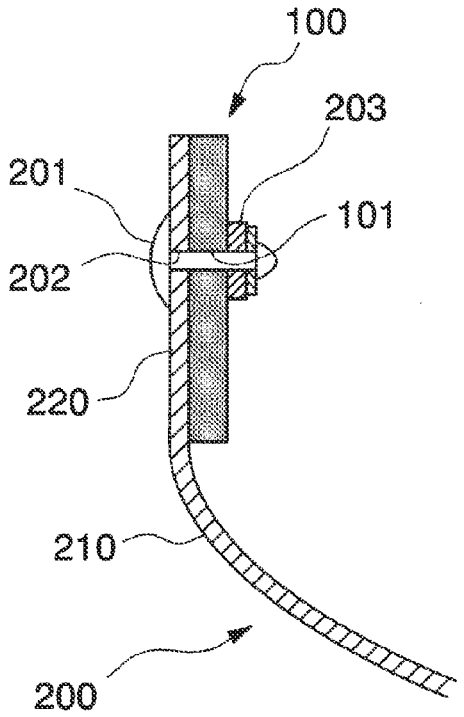
FIG. 14 is an illustrative diagram that shows one example of the method of attaching the radiowave absorber according to the one exemplary embodiment of the present invention to the parabolic antenna.

Referring to FIG. 14, an example of the method of attaching the radiowave absorber 100 to the shroud 220 is shown.

FIG. 14 is an explanatory diagram that shows one example of attaching the radiowave absorber 100.

As shown in FIG. 14, a hole 101 that allows passage of a bolt (fixing member) 201 is formed in the radiowave absorber 100. Also, a hole 202 that allows insertion of the bolt 201 is formed in the shroud 220 at a location corresponding to the hole 101 of the radiowave absorber 100. The bolt 201 is inserted from the outer side of the shroud 220 into these holes 101 and 202. A screw portion of the bolt 201 passes through the shroud 220 and the radiowave absorber 100, and this screw portion projects from the inner side of the radiowave absorber 100.

A washer nut (fixing member) 203 is threaded onto the distal end of the bolt 201 that projects from the radiowave absorber 100. With this kind of configuration, the radiowave absorber 100 is fastened to the shroud 220 by the bolt 201 and the washer nut 203.

The bolt 201 and the washer nut 203 are each formed with a dielectric material or metal. However, from the aspect of inhibiting reflection of radiowaves, it is preferable to form the bolt 201 and the washer nut 203 with a dielectric material than a metal. In the case of wanting to more efficiently suppress reflection of radiowaves, it is preferable to form the bolt 201 and the washer nut 203 with a dielectric material that includes conductive particles. As the fixing members that fix the radiowave absorber 100 to the shroud 220, it is possible to use a screw and nut instead of the bolt 201 and the washer nut 203.

Figure 15:
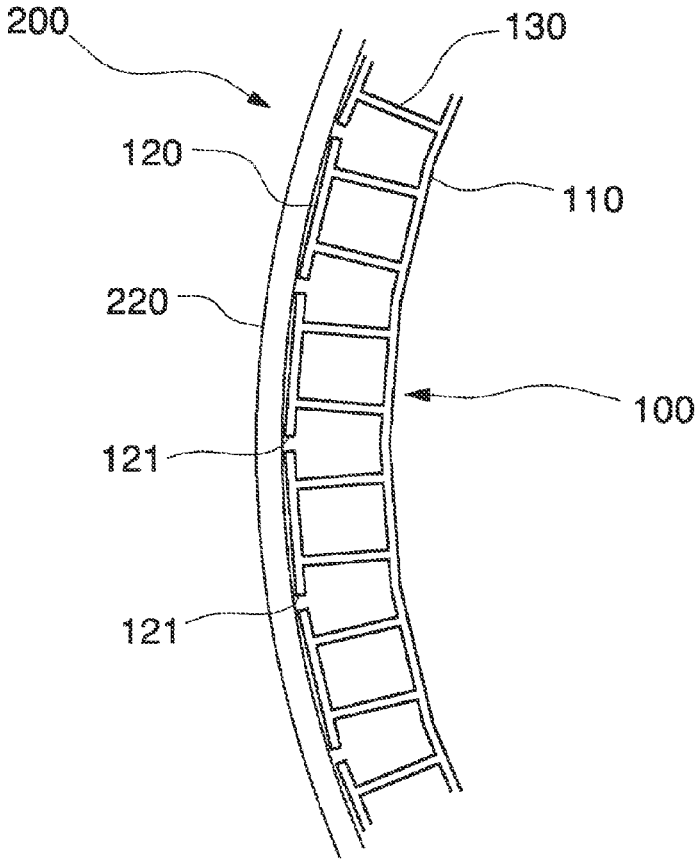
FIG. 15 is a diagram that shows still another example of the radiowave absorber according to the one exemplary embodiment of the present invention installed in the parabolic antenna.
Figure 16:
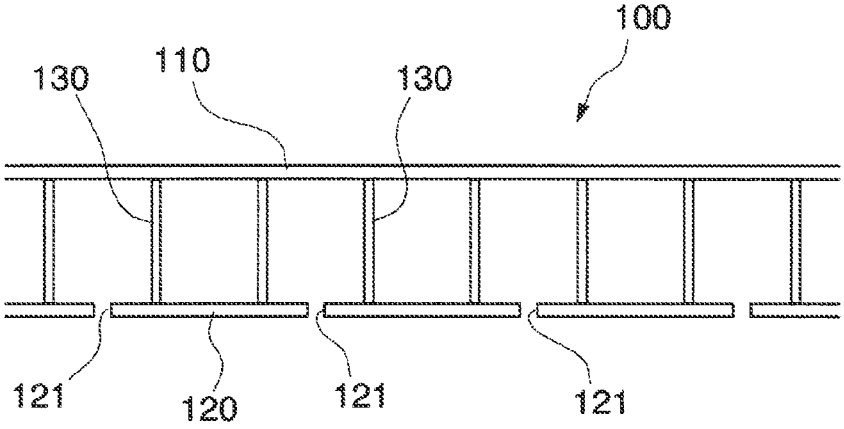
FIG. 16 is a diagram that shows the constitution of the radiowave absorber shown in FIG. 15.

FIG. 15 is a diagram that shows still another example of the radiowave absorber 100 installed in the parabolic antenna 200. FIG. 16 is a structural diagram of the radiowave absorber 100 in FIG. 15.

As shown in FIG. 15 and FIG. 16, when disposing the radiowave absorber 100 on the inner circumference of the shroud 220 in the parabolic antenna 200, a plurality of slits 121 are formed in the lower plate 120 of the radiowave absorber 100 at equal intervals along the circumferential direction of the shroud 220 (that is, in the direction along the lower plate 120). When the lower plate 120 of the radiowave absorber 100 in which the slits 121 are formed in this way is curved so as to follow the inner side circumference of the shroud 220, the width of the slits 121 widens, so it is possible to prevent immoderate stress from acting on the lower plate 120. For that reason, even in the case of the curvature radius of the shroud 220 being small, it is possible to cause the radiowave absorber 100 to reliably adhere closely with the shroud 220.

The interval at which the plurality of slits 121 are formed changes depending on the curvature radius of the shroud 220. For example, in the case of the curvature radius of the shroud 220 being 150 mm to 300 mm, the interval of the plurality of slits 121 is preferably 30 mm to 60 mm. In the case of the curvature radius of the shroud 220 exceeding 600 mm, since an immoderate stress does not act on the lower plate 120 of the radiowave absorber 100, it is possible to attach the radiowave absorber 100 as is to the shroud 220 without forming the slits 121.

Figure 17:
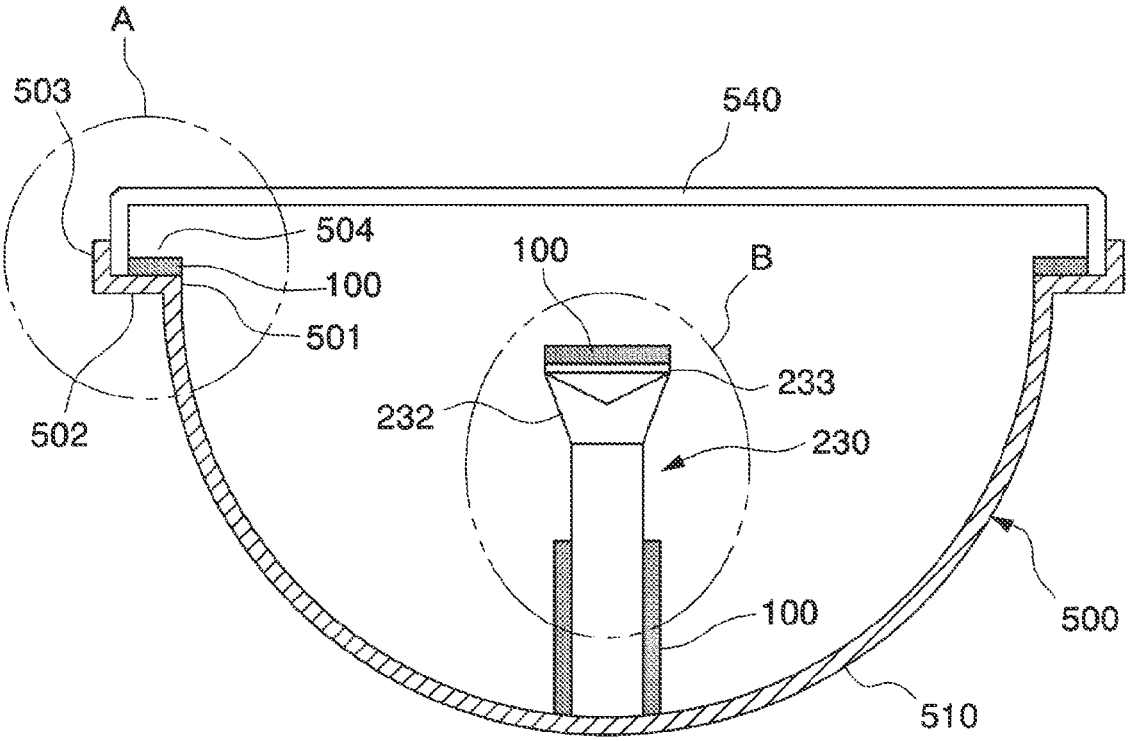
FIG. 17 is a diagram that shows an example of the radiowave absorber according to the one exemplary embodiment of the present invention installed in another parabolic antenna.
Figure 18:
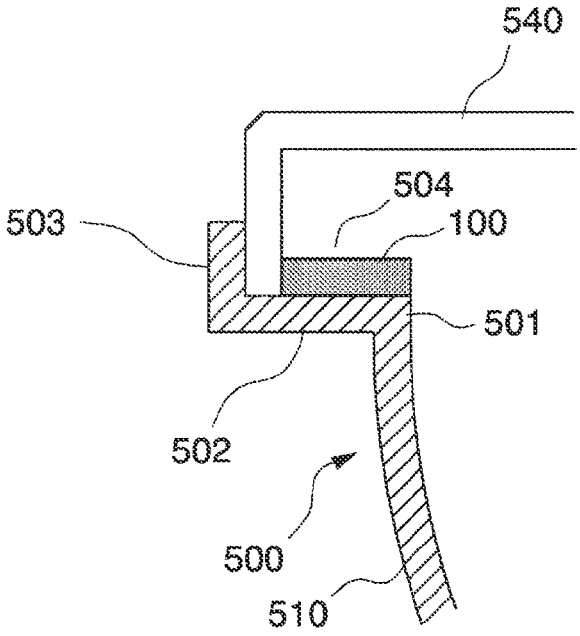
FIG. 18 is a close-up view of the portion A in FIG. 17.
Figure 19:
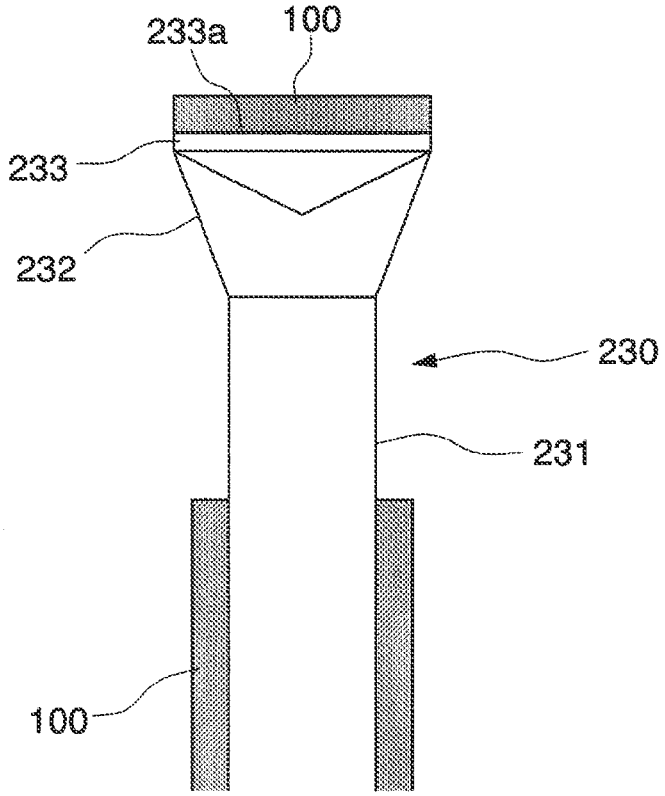
FIG. 19 is a close-up view of the portion B in FIG. 17.

FIG. 17 is a diagram that shows an example of the radiowave absorber 100 installed in another parabolic antenna 500. FIG. 18 is a close-up view of portion A in FIG. 17. FIG. 19 is a close-up view of portion B in FIG. 17. In the following description, the same reference symbols are given to the same forms as the aforementioned parabolic antenna 200.

As shown in FIG. 17 and FIG. 18, the parabolic antenna 500 includes a reflector (parabolic reflector) 510, and a primary radiator 230, without having a shroud. A radome 540 is provided at an aperture 501 of the reflector 510. An outer flange portion 502 is integrally formed at the aperture 501 of the reflector 510. A wall 503 that rises perpendicularly from the outer edge is formed at the outer flange portion 502. The inside of this wall 503 is constituted as a radome mounting portion 504 for attaching the radome 540.

The radiowave absorber 100 is arranged over the entire circumference of the outer flange portion 502. By arranging the radiowave absorber 100 on the outer flange portion 502, it is possible to provide the parabolic antenna 500 in which re-radiation of current that flows in the radome mounting portion 504 is suppressed, side lobes are decreased, and the FB ratio (front-to-back ratio) is high. The radiowave absorber 100 may be arranged at a portion of the outer flange portion 502.

As shown in FIG. 17 and FIG. 19, the primary radiator 230 has a cylindrical waveguide 231, a support body 232 that is provided at the distal end of this waveguide 231 and that is formed by a dielectric material, and a sub-reflector 233 that is supported by the support body 232. The radiowave absorber 100 is arranged on the back surface 233*a* of this sub-reflector 233.

By arranging the radiowave absorber 100 on the back surface 233*a* of this sub-reflector 233, it is possible to provide the parabolic antenna 500 in which re-radiation of current that flows on the sub-reflector 233 is suppressed, and side lobes are decreased.

Moreover, the radiowave absorber 100 is arranged on the outside periphery of the waveguide 231. As shown in FIG. 16, the radiowave absorber 100 that is arranged on the outside periphery of the waveguide 231 also has the slits 121 formed in the lower plate 120. This lower plate 120 is arranged so as to make contact with the waveguide 231. By doing so, it is possible to arrange the radiowave absorber 100 on the waveguide 231 with a small curvature radius.

By arranging the radiowave absorber 100 on the waveguide 231, it is possible to provide the parabolic antenna 500 in which re-radiation of current that flows on the waveguide 231 is suppressed, and side lobes are decreased.

In the present exemplary embodiment, the description was given for the case of arranging the radiowave absorber 100 on the outer flange portion 502, the sub-reflector 233, and the waveguide 231 of the parabolic antenna 500. However, it is not limited to this, and the radiowave absorber 100 may be arranged on only at least any one of the outer flange portion 502, the sub-reflector 233, and the waveguide 231. Also, the radiowave absorber 100 may also be arranged on the sub-reflector 233 and the waveguide 231 of the primary radiator 230 of the aforementioned parabolic antenna 200 that has the shroud 220.

As mentioned above, according to the exemplary embodiment of the present invention, it is possible to provide a lightweight and inexpensive radiowave absorber. Also, by adjusting the resistance and the height of the support portion, it is possible to improve the absorption performance corresponding to the wavelength. Also, by adjusting the structure of the support portion, the oblique incidence characteristic is improved. Also, according to the present exemplary embodiment resistance powders do not scattered and degradation hardly occurs over time unlike existing absorbers. Also, by providing holes in the radiowave absorber, the absorption performance and oblique incidence characteristic are improved. In addition, by attaching to the shroud of a parabolic antenna, it becomes an antenna with low side lobes.

In this manner, the exemplary embodiment of the present invention is effective technology for constituting a parabolic antenna that is inexpensive, with low side lobes, and high performance. Since the present technology is technology that relates to a constitution of an inexpensive radiowave absorbing section for suppressing side lobes, it can also be utilized in related technology that requires installation of a radiowave absorber for avoiding radiowave interference.

Hereinabove, the invention of the present application was described with reference to the exemplary embodiment, but the present invention is not limited to the aforementioned exemplary embodiment. Various modifications that can be understood by a person skilled in the art within the scope of the present invention can be made to the constitutions and details of the present invention.

This application is based upon and claims the benefit of priority from Japanese patent application No. 2010-030712, filed Feb. 15, 2010, Japanese patent application No. 2010-048284, filed Mar. 4, 2010, and Japanese patent application No. 2010-140949, filed Jun. 21, 2010, the disclosures of which are incorporated herein in their entirety by reference.

INDUSTRIAL APPLICABILITY

The present invention can be applied to a radiowave absorber and a parabolic antenna. According to the present invention, it is possible to provide a lightweight and inexpensive radiowave absorber.

(Addendum 1)

In the radiowave absorber, the structure of the support portion is semicircular.

(Addendum 2)

The radiowave absorber includes at least one intermediate plate that is arranged between the upper plate and the lower plate to be parallel with the upper plate and the lower plate, and formed with a dielectric material that includes conductive particles, and the support portions are provided at least between the upper plate and the intermediate plate, and between the intermediate plate and the lower plate.

(Addendum 3)

In the radiowave absorber, a plurality of holes are formed in the upper plate or the lower plate or both.

(Addendum 4) In the parabolic antenna, the radiowave absorber is fixed by a fixing member.

(Addendum 5)

In the parabolic antenna, the fixing member is formed by a dielectric material that includes conductive particles.

DESCRIPTION OF REFERENCE SYMBOLS

100 Radiowave absorber
101 Hole
110 Upper plate
120 Lower plate
121 Slit

130 Support portion
140 Metal plate
150 Intermediate plate
160 Hole
200 Parabolic antenna
201 Bolt (fixing member)
202 Hole
203 Washer nut (fixing member)
210 Reflector (parabolic reflector)
220 Shroud
230 Primary radiator
231 Waveguide
232 Support body
233 Sub-reflector
233*a* Back surface
240 Radome
250 Spacer
400 Parabolic antenna
410 Reflector (parabolic reflector)
430 Primary radiator
500 Parabolic antenna
501 Aperture
502 Outer flange portion
503 Wall
510 Reflector (parabolic reflector)
540 Radome
800 Radiowave absorber
900 Parabolic antenna
910 Reflector (parabolic reflector)
920 Shroud
930 Primary radiator

The invention claimed is:

1. A radiowave absorber comprising:

an upper plate that includes a dielectric material containing conductive particles, the upper plate having a surface in which a plurality of holes are formed;

a lower plate that is parallel to the upper plate, and includes a dielectric material that contains conductive particles; and a plate-shaped support portion that is between the upper plate and the lower plate, and supports the upper plate and the lower plate, wherein the upper plate and the lower plate each are a thin plate, each said thin plate having a surface with a coating including conductive particles, and wherein the lower plate has first and second sides opposite to each other and a plurality of slits spaced from each other at equal intervals, the plurality of slits extending in a same direction from the first side to the second side.

2. The radiowave absorber according to claim 1, further comprising a metal plate that is arranged under the lower plate.

3. The radiowave absorber according to claim 2, wherein structure of the support portion has a plate shape that is perpendicular to the upper plate and the lower plate.

4. The radiowave absorber according to claim 2, wherein structure of the support portion has a plate shape that slopes with respect to the upper plate and the lower plate.

5. The radiowave absorber according to claim 2, wherein each said thin plate includes polypropylene.

6. The radiowave absorber according to claim 1, wherein structure of the support portion has a plate shape that is perpendicular to the upper plate and the lower plate.

7. The radiowave absorber according to claim 1, wherein structure of the support portion has a plate shape that slopes with respect to the upper plate and the lower plate.

8. The radiowave absorber according to claim 1, wherein structure of the support portion has a corrugated shape.

9. The radiowave absorber according to claim 1, wherein the support portion includes a dielectric material.

10. The radiowave absorber according to claim 1, wherein the support portion includes a dielectric material that contains conductive particles.

11. The radiowave absorber according to claim 1, wherein the plurality of holes are uniformly spaced apart.

12. The radiowave absorber according to claim 1, wherein the plurality of holes extend completely through the upper plate and do not extend through the lower plate.

13. A parabolic antenna comprising a radiowave absorber that comprises:

an upper plate that includes a dielectric material containing conductive particles, the upper plate having a surface in which a plurality of holes are formed;

a lower plate that is arranged parallel to the upper plate, and includes a dielectric material that contains conductive particles; and a plate-shaped support portion that is arranged between the upper plate and the lower plate, and supports the upper plate and the lower plate, wherein the upper plate and the lower plate each are a thin plate, each said thin plate having a surface with a coating including conductive particles, and wherein the lower plate has first and second sides opposite to each other and a plurality of slits spaced from each other at equal intervals, the plurality of slits extending in a same direction from the first side to the second side.

14. The parabolic antenna according to claim 13, further comprising:

a parabolic reflector that reflects radiowaves; and a primary radiator that radiates radiowaves, wherein the radiowave absorber is arranged close to an aperture edge of the parabolic reflector.

15. The parabolic antenna according to claim 13, further comprising:

a parabolic reflector that reflects radiowaves; and a primary radiator that includes a waveguide, a support body including a dielectric material and provided at a distal end of the waveguide, and a sub-reflector supported by the support body, the primary radiator radiating radiowaves, wherein the radiowave absorber is arranged on a back surface of the sub-reflector.

16. The parabolic antenna according to claim 13, further comprising:

a parabolic reflector that reflects radiowaves; and a primary radiator that includes a waveguide, a support body including a dielectric material and arranged at a distal end of the waveguide, and a sub-reflector supported by the support body, the primary radiator radiating radiowaves, wherein the radiowave absorber is arranged on an outside circumference of the waveguide.

17. The parabolic antenna according to claim 13, further comprising:

a parabolic reflector that reflects radiowaves;

a cylindrical shroud that is attached to an aperture edge of the parabolic reflector so as to maintain an aperture of the parabolic reflector; and a primary radiator that radiates radiowaves, wherein the radiowave absorber is arranged on an inside perimeter of the shroud.

18. The parabolic antenna according to claim 17, wherein the radiowave absorber is arranged in close contact along at least one of a perimeter direction and a radiation direction of the shroud.

19. The parabolic antenna according to claim 17, wherein the radiowave absorber is periodically arranged along at least one of a perimeter direction and a radiation direction of the shroud while maintaining a suitable interval.

20. The parabolic antenna according to claim 17, wherein a spacer is arranged on an inside perimeter of the shroud, and the radiowave absorber is arranged on the spacer.

* * * * *